US009039155B2

(12) United States Patent
Smith et al.

(10) Patent No.: US 9,039,155 B2
(45) Date of Patent: May 26, 2015

(54) INK MIXING SYSTEM

(71) Applicant: VIDEOJET TECHNOLOGIES INC., Wood Dale, IL (US)

(72) Inventors: Robert Smith, Thrapston (GB); Michael Stamp, Oadby (GB); John Bostock, Thorpe Langton (GB); Carl Mann, St. Ives (GB); Trevor Lye, Cambridge (GB)

(73) Assignee: Videojet Technologies Inc., Wood Dale, IL (US)

( * ) Notice: Subject to any disclaimer, the term of this patent is extended or adjusted under 35 U.S.C. 154(b) by 41 days.

(21) Appl. No.: 13/710,875

(22) Filed: Dec. 11, 2012

(65) Prior Publication Data

US 2014/0002551 A1 Jan. 2, 2014

Related U.S. Application Data

(62) Division of application No. 13/017,195, filed on Jan. 31, 2011, now Pat. No. 8,371,684.

(51) Int. Cl.

| | |
|---|---|
| ***B41J 2/17*** | (2006.01) |
| ***B41J 2/175*** | (2006.01) |
| ***B41J 2/18*** | (2006.01) |

(52) U.S. Cl.

CPC ..... *B41J 2/17596* (2013.01); *B41J 2/175* (2013.01); *B41J 2/17513* (2013.01)

(58) Field of Classification Search

CPC .... B41J 2/175; B41J 2/17503; B41J 2/17513; B41J 2/17533; B41J 2/211

See application file for complete search history.

(56) References Cited

U.S. PATENT DOCUMENTS

| | | | | |
|---|---|---|---|---|
| 6,250,752 | B1 * | 6/2001 | Tajima et al. | 347/92 |
| 6,863,386 | B2 * | 3/2005 | Hatada et al. | 347/84 |
| 7,182,444 | B2 * | 2/2007 | Kawamoto | 347/85 |
| 2009/0295881 | A1 * | 12/2009 | Tasaka et al. | 347/85 |
| 2010/0220128 | A1 * | 9/2010 | Zaba et al. | 347/6 |
| 2012/0140003 | A1 * | 6/2012 | Szusdziara et al. | 347/85 |
| 2012/0200649 | A1 * | 8/2012 | Igawa et al. | 347/89 |

* cited by examiner

*Primary Examiner* — Stephen Meier
*Assistant Examiner* — Renee I Wilson
(74) *Attorney, Agent, or Firm* — Joseph A. Yosick

(57) ABSTRACT

An ink system of an ink jet printer includes a fluid tank. The fluid tank includes a generally conically shaped side wall, the side wall sloping inwardly from a top portion to a bottom portion. A bottom surface is disposed adjacent the bottom portion of the side wall. A first fluid conduit is disposed in the fluid tank and includes an opening adjacent to and above the bottom surface of the fluid tank. A second fluid conduit is disposed in the fluid tank and includes an opening at a location above the opening of the first fluid conduit. A pump is in fluid communication with the first fluid conduit and the second fluid conduit. An ink supply line is in fluid communication with the pump. A print head is in fluid communication with the ink supply line.

11 Claims, 2 Drawing Sheets

INK MIXING SYSTEM

RELATED APPLICATIONS

This application is a Divisional of U.S. application Ser. No. 13/017,195, filed Jan. 31, 2011, the contents of which are incorporated herein by reference in its entirety.

BACKGROUND

The present disclosure relates to a circulation system for mixing ink jet ink and in particular to a circulation system for mixing pigmented ink jet ink.

Ink jet printing is a well-known technique by which printing is accomplished without contact between the printing device and the substrate on which the printed characters are deposited. Briefly described, ink jet printing involves the technique of projecting a stream of ink droplets to a surface and controlling the direction of the stream so that the droplets are caused to form the desired printed image on that surface. This technique of noncontact printing is well suited for application of characters onto a variety of surfaces including porous and non-porous surfaces.

Pigmented ink, which includes insoluble pigment particles, may be used in ink jet printing. Although it has a number of desirable characteristics, pigmented ink also has a significant drawback. The pigment particles tend to agglomerate and settle at the bottom surface of the ink supply container, causing nozzle clogging and disruption in printing, as well as a decrease in print contrast. The nozzles typically have a diameter around about 2.5 to 3.0 thousandths of an inch, so agglomerated particles have a high tendency to clog the nozzles.

BRIEF SUMMARY

The present disclosure provides an ink system to mix a pigmented ink composition and minimize problems with pigment settling in the ink system.

In one aspect, an ink system of an ink jet printer includes a fluid tank. The fluid tank includes a generally conically shaped side wall, the side wall sloping inwardly from a top portion to a bottom portion. A bottom surface is disposed adjacent the bottom portion of the side wall. A first fluid conduit is disposed in the fluid tank and includes an opening adjacent to and above the bottom surface of the fluid tank. A second fluid conduit is disposed in the fluid tank and includes an opening at a location above the opening of the first fluid conduit. A pump is in fluid communication with the first fluid conduit and the second fluid conduit. An ink supply line is in fluid communication with the pump. A print head is in fluid communication with the ink supply line. A return line is in fluid communication between the print head and the fluid tank.

In another aspect, a method of operating an ink jet printer includes providing an ink system. The ink system includes a fluid tank with a generally conically shaped side wall. The side wall slopes inwardly from a top portion to a bottom portion. A bottom surface is disposed adjacent the bottom portion of the side wall. An ink composition including a pigment is disposed in the fluid tank. A first fluid conduit is disposed in the fluid tank and includes an opening adjacent and above the bottom surface of the fluid tank. A second fluid conduit is disposed in the fluid tank and includes an opening at a location above the opening of the first fluid conduit. A mixing process is performed. The ink composition is conveyed into the second fluid conduit and out of the first fluid conduit into the fluid tank for a first period of time. The first period of time is at least 30 s. The flow of the ink composition is reversed to convey the ink composition into the first fluid conduit and out of second fluid conduit into the fluid tank for a second period of time, wherein the second period of time is at least 1 min, thereby mixing the ink composition.

In another aspect, a method of operating an ink jet printer includes providing an ink system. The ink systems includes a fluid tank with a generally conically shaped side wall, the side wall sloping inwardly from a top portion to a bottom portion, and a bottom surface disposed adjacent the bottom portion of the side wall. An ink source including a volume of ink and a solvent source including a volume of solvent is provided. Substantially the entire volume of ink is transferred to the fluid tank through a supply line. A portion of the volume of solvent is transferred through the ink supply line to flush the supply line.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
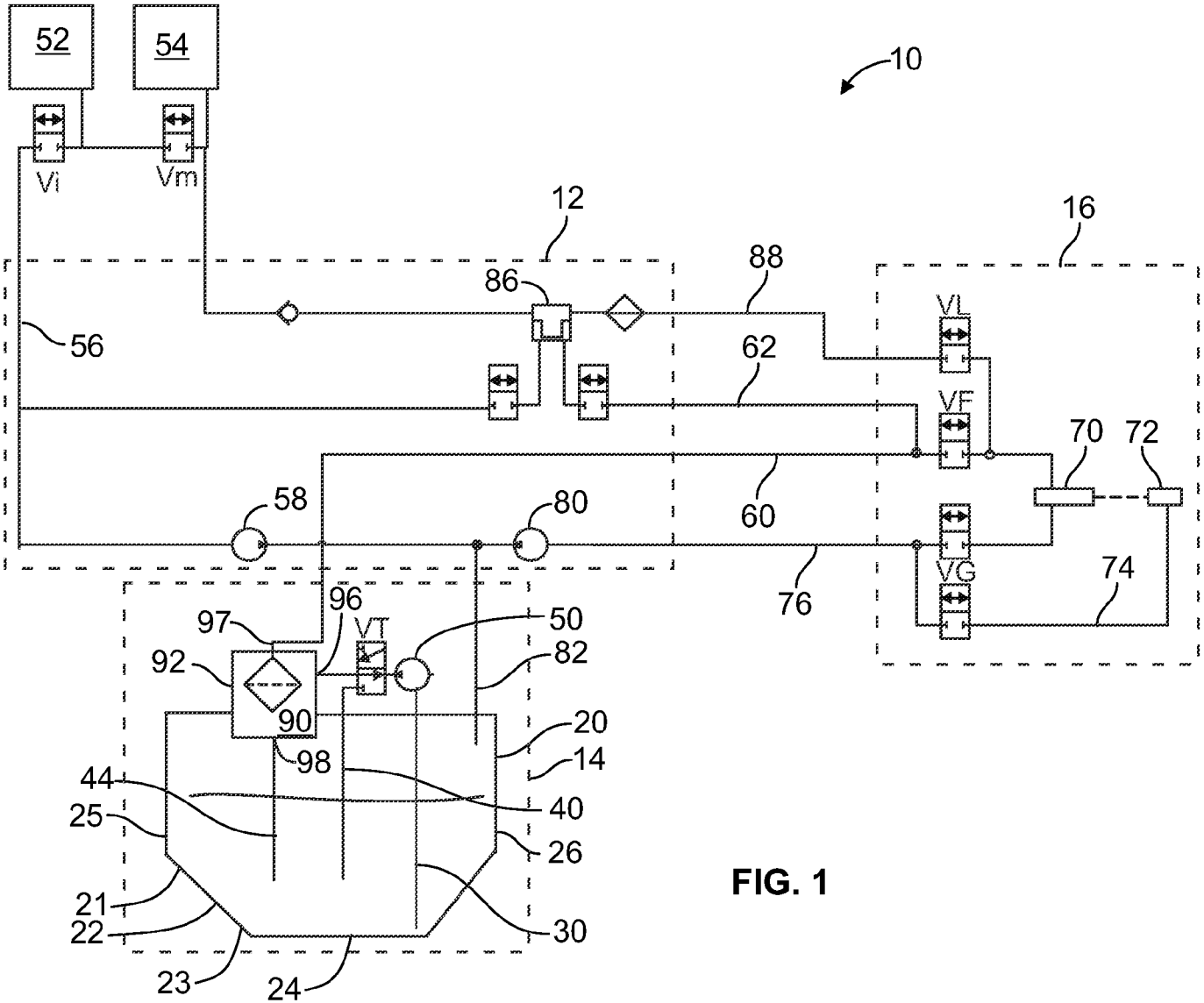
FIG. 1 is a schematic view of a printer system including an embodiment of a print head.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides an ink system for an ink jet printer that is particularly useful for printing pigmented inks. In particular, the ink system reduces or eliminates pigment settling to allow for a homogeneous ink composition to be used for printing. Additionally, the present system provides method for minimizing pigment settling throughout the system to allow for operation of the print head without nozzle clogging for extended periods of time.

A schematic layout of the ink system 10 is shown in FIG. 1. For the sake of convenience, components of the system may be grouped as a valve module 12, a core module 14, and a print head 16. The ink system 10 includes fluid tank 20, a first fluid conduit 30 disposed in the fluid tank 20, and a second fluid conduit 40 disposed in the tank 20. The bottom portion of fluid tank 20 includes a generally conically shaped side wall 22. The side wall 22 slopes inwardly from a top portion 21 to the bottom portion 23. A bottom surface 24 is disposed adjacent the bottom portion 23 of the side wall 22. First conduit 30 and second conduit 40 are used to remove ink from the tank 20 and recirculate it back to the tank 20, depending on the operating condition of the system 10. The fluid tank 20 is especially suitable for use with a pigment based ink composition.

Figure 2:
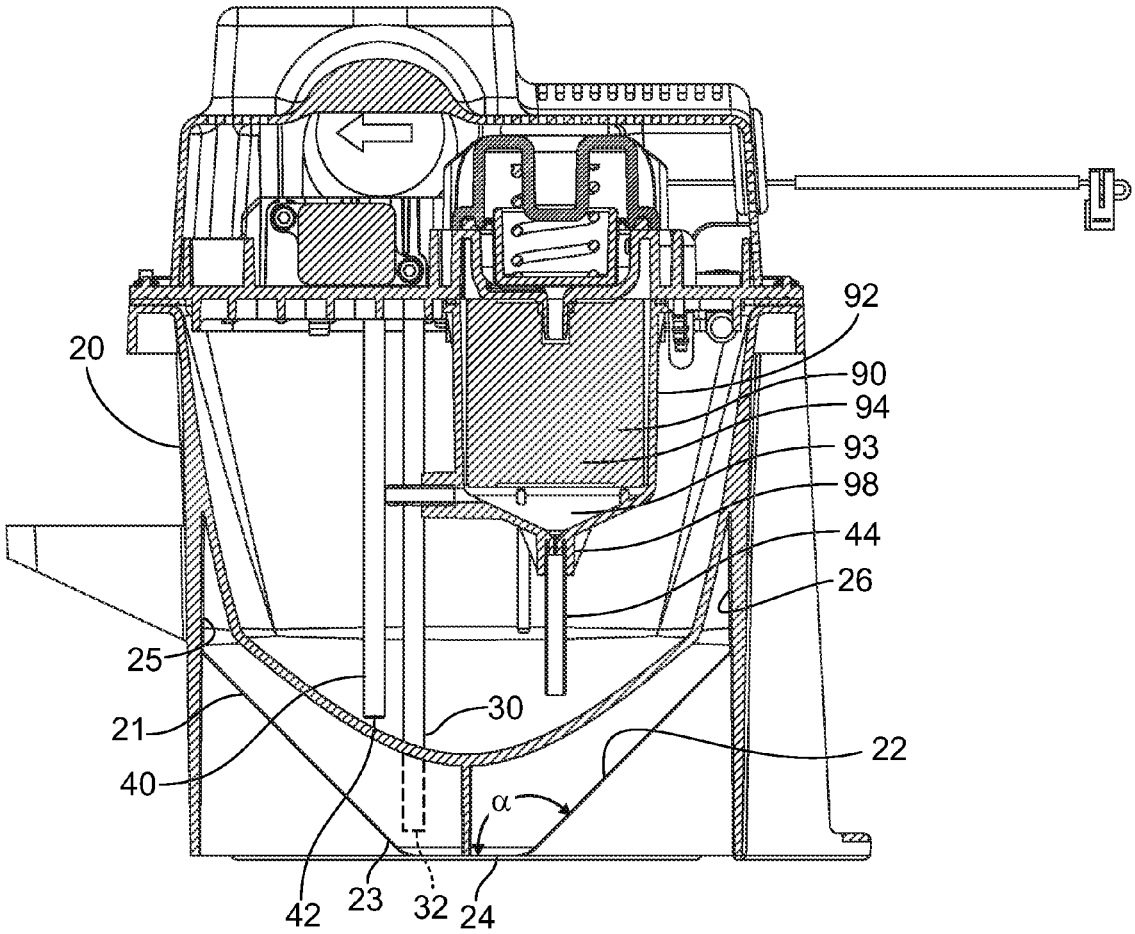
FIG. 2 is a sectional view of an embodiment of a fluid tank.

FIG. 2 is a sectional view of an embodiment of the fluid tank 20. In one embodiment, fluid tank 20 is about 1 L in volume. The top portion of fluid tank 20 may include side walls 25 and 26. As previously described, the bottom portion of fluid tank 20 includes a generally conically shaped side wall 22 that slopes inwardly from a top portion 21 (connected to side walls 25 and 26) to the bottom portion 23 adjacent bottom surface 24. In one embodiment, the bottom surface 24 is circular in shape and about 25 mm in diameter. In the same embodiment, side walls 25 and 26 along with front and back walls (not shown) may provide a generally square frame (when viewed from the top), and walls 25 and 26 are about 150 mm apart at the farthest point. Conically shaped side wall 22 may slope to the bottom surface 24 at an angle $\alpha$ with respect to the bottom surface 24. The angle $\alpha$ is preferably between 105° and 165°, more preferably between 120° and 150°. These dimensions are provided by way of example only and it is to be understood that a variety of dimensions and shapes of fluid tank 20 may be used.

First conduit 30 includes an opening 32 adjacent to and above the bottom surface 24 of the fluid tank 20. Opening 32 is preferably located between less than about 1 inch, more preferably less than about 0.25 inches from the bottom surface 24. The second fluid conduit 40 includes an opening 42 disposed in the fluid tank 20 at a location above the opening 32 of the first fluid conduit 30. Opening 32 may be positioned between about 1 and 2 inches from the bottom surface 24.

Turning back to FIG. 1, the ink system 10 also includes an ink pump 50 in fluid communication with the first fluid conduit 30. The ink pump 50 may be any suitable fluid pump. Examples suitable pumps include a piston-type pump, a diaphragm pump, a vane pump and a gear pump. In general, the pump can be any device that generates a pressure difference between its inlet and outlet ports. The pump can be powered electrically, hydraulically, pneumatically or mechanically. The ink pump 50 is operable to convey fluid in either direction from fluid conduit 30.

The system 10 may include an ink source 52 and a solvent or make-up source 54. The ink source 52 and solvent or make-up source 54 may be provided in bottles, cartridges, or any other suitable containers. Flow of fluid out of ink source 52 and make-up source 54 are controlled by valves Vi and Vm, respectively. Ink and/or make-up fluid may be provided to fluid tank 20 via supply line 56 and transfer pump 58. In one embodiment, the ink source 52 provides a volume of ink. If the ink source 52 contains a pigmented ink composition, the container of ink source 52 should be thoroughly agitated to suspend the pigment particles. After the ink source 52 is provided and connected to the ink system 10, substantially the entire volume of ink is transferred at one time to the fluid tank 20 through supply line 56. By draining the entirety of ink source 52, there is no need for further agitation or mixing of ink source 52. After the ink is transferred to the fluid tank 20, solvent is transferred from solvent source 54 through the supply line 56 to fluid tank 20 in order to flush the pigment from the supply line 56. Solvent from solvent source 54 may also be periodically provided to fluid tank 20 to replace solvent loss through evaporation during printing.

An ink supply line 60 is in fluid communication with the pump 50, thus providing ink to nozzle 70 in print head 16. A valve VF operates to control flow of the ink to the nozzle 70. Ink is supplied to print head 16 from tank 20 via conduit 30, pump 50, and ink supply line 60. When the nozzle 70 is printing, gutter 72 collects unused ink droplets and recirculates them back via gutter line 74, return line 76, gutter pump 80, and line 82 back to fluid tank 20. Valve VG controls the flow of fluid via gutter line 74. During a flushing or cleaning process, make-up fluid may be supplied to nozzle 70 via flush line 88 and flush pump 86, as will be described in further detail below. Flush pump 86 may be a double-chambered diaphragm pump to provide for both solvent flow through flush line 88 and ink flow through line 62. The various valves are preferably media-separated valves, such as commercially available media separated valves that are separated with an elastomer.

The ink system 10 preferably includes a filter module 90 in fluid communication with the pump 50. As shown in FIGS. 1 and 2, the filter module 90 includes a housing 92 and filter media 94 disposed in the housing 92. A fluid inlet 96 is disposed in a side portion of the housing 92. A first fluid outlet 97 is disposed in a top portion of the housing 92, with the filter media 94 disposed between the fluid inlet 96 and the fluid outlet 97. A second fluid outlet 98 is disposed in a bottom portion of the housing 92 and connects to conduit 44. The area 93 of the filter 90 above the filter outlet 98 is preferably conically shaped to help prevent settling of pigment within the filter module 90. During normal operation of the printer, fluid flows in through inlet 96 and out through both outlet 97 (to ink supply line 60) and outlet 98 (back to fluid tank 20). The flow out of outlet 98 serves a mixing function by providing continuous flow of the ink composition to help keep the pigment suspended in fluid tank 20.

Figure 3A:
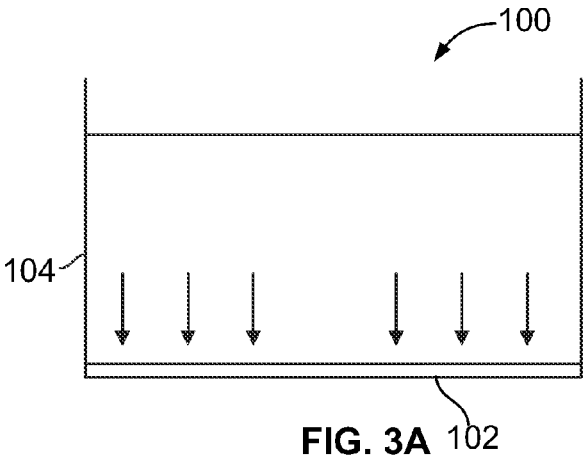
FIG. 3A (Prior Art)
FIG. 3A is a schematic view of the fluid tank of a prior art printer system.

When a printer using pigmented ink is not printing, the pigment in the ink composition tends to settle to the bottom of an ink container. When the system is restarted, this settled pigment must be re-dispersed into the rest of the ink fluid. A prior art ink system 100 is shown in FIG. 3A. In the prior art system, pigment 102 settles in the bottom of the tank 104 and is very difficult to re-suspend. In the present system, shown in FIG. 3B, the pigment tends to settle in a small area 110 at the bottom of the tank 20, due to the conical shape of the tank 20.

Figure 3B:
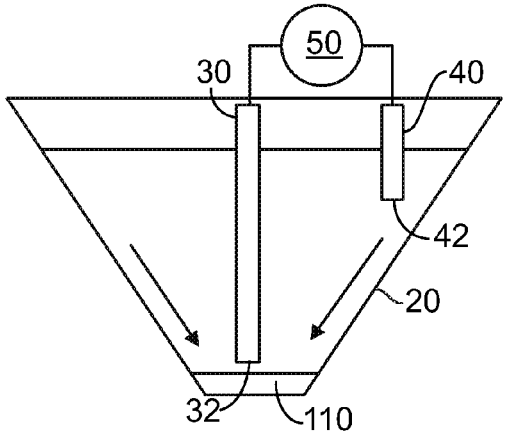
FIG. 3B is a schematic view of the fluid tank of the present disclosure.

In one embodiment, the system 10 includes various mixing and purging procedures to ensure that the pigment is properly dispersed in the fluid. The mixing procedure may occur on startup and/or at regular intervals (e.g. once a day). In one method, suspension of the pigment is accomplished by conveying the ink composition into the second fluid conduit 40 and then back out of the first fluid conduit 30 and into the fluid tank 20 for a first period of time. As shown in FIG. 3B, with the conical tank 20, the pigment tends to settle in the central area 110 at the bottom of the tank. When fluid flow is provided out of the first conduit 30, the fluid flow "blasts" the settled pigment at the bottom of the tank back into dispersion in the fluid. This first period of time is preferably at least 30 s, more preferably about 1 min. The period of time is preferably less than 5 minutes. The flow rate of the fluid through the pump 50 and conduits 30 and 40 is preferably about 1 to 2 L/min.

After this first flow, the direction of flow by the pump 50 is reversed, so that ink flows into first conduit 30 and out of second conduit 40 for a second period of time. The second period of time is preferably at least 1 minute, more preferably at least 2 minutes, and most preferably at least 5 minutes. The period of time is preferably less than 10 minutes. The first conduit 30 picks up the fluid at the bottom of the tank 20. If the pump 50 is a gear pump, the gears of pump 50 mix the pigment particles and the fluid to help disperse. The fluid is then returned to the tank 20. In one embodiment, valve VT controls the flow of fluid through conduit 40. During the mixing procedure, valve VT is open to allow flow to and from conduit 40. During normal use, valve VT is closed so the fluid flows from ink pump 50 into filter module 90 and then to ink supply line 60. It has been found that the two step mixing procedure describe above works extremely well to thoroughly mix the ink composition in a short period of time (about 6 minutes total), in comparison to prior art mixing systems.

The system 10 may also include filter purge process to remove settled pigment out of filter module 90, including housing 92 and filter media 94. During the filter purge process, ink pump 50 is used to convey fluid from the fluid tank 20 into conduit 30 to filter module 90 and then out of outlet 98 through conduit 44. The generally conical shape of area 93 helps to ensure that sediment is able to be flushed out of outlet 98 back into the fluid tank 20. The filter purge process may take about 1 minute.

The mixing procedure may also include a procedure for purging the ink supply line 60 and the return line 62. By purging is meant that the lines are flushed with mixed ink composition from tank 20 to help remove any settled pigment in the lines. The ink composition is transferred via conduit 30 and ink pump 50 to ink supply line 60, bypassing the nozzle 70 with valve VF closed, and then back through return line 62 via transfer pump 58 back into line 82. This cycle is done for a sufficient period of time to essentially flush the lines 60 and 62 of settled pigment.

Another area that is problematic for printing systems for pigmented ink is that when the printer is shut down, pigment tends to settle in the fluid lines and other components of the system. The ink system 10 is configured to include features to minimize or prevent the settling of pigment within the lines or other components.

During operation of the print system during printing mode, ink flows from the fluid tank 20, through feed line 60, and through open valve VF to the nozzle 70. When the system is not actively printing, valve VF is closed. The system 10 may perform a flush cycle at certain periods of time, such as shutdown, startup, or as part of a regular cleaning procedure. During this flush cycle, the print head 16 may be flushed with solvent to remove ink from the nozzle(s) 70 in print head 16. During shutdown, valve VL is used to change from ink flow to solvent flow to print head 16. Thus, solvent flows through line 88 from flush pump 86 through valve VL to nozzle 70 and gutter 72. Gutter pump 80 pulls solvent and air into line 76 from gutter line 74, and thence back to ink tank 20 via line 82. This procedure removes nearly all the ink from the nozzle(s) in print head 70.

The present invention further provides an ink jet printer that includes the ink system described above. The printer can be of any type, such as a continuous ink jet printer or a drop-on-demand ink jet printer. The ink system 10 is especially suitable for use with a 1000-series continuous ink jet system available from Videojet Technologies Inc. (Wood Dale, Ill.). The operation of the various valves and pumps of the system 10 may provided by a standard controller, which may be provided as an integrated component or a separate computer. Such controllers are well known in the art.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. An ink system of an ink jet printer comprising:
- a fluid tank comprising:
  - a generally conically shaped side wall, the side wall sloping inwardly from a top portion to a bottom portion; and
  - a bottom surface disposed adjacent the bottom portion of the side wall;
- a first fluid conduit disposed in the fluid tank and comprising an opening adjacent to and above the bottom surface of the fluid tank;
- a second fluid conduit disposed in the fluid tank and comprising an opening at a location above the opening of the first fluid conduit;
- a pump in fluid communication with the first fluid conduit and the second fluid conduit;
- an ink supply line in fluid communication with the pump;
- a print head in fluid communication with the ink supply line; and
- a return line in fluid communication between the print head and the fluid tank, wherein the return line allows circulation of a fluid from the supply line to the fluid tank.

2. The ink system of claim 1 further comprising an ink composition comprising a pigment disposed in the fluid tank.

3. The ink system of claim 2 further comprising an ink source in fluid communication with the fluid tank, wherein the ink source comprises a pigmented ink composition provided in a cartridge.

4. The ink system of claim 1 wherein the first opening is disposed less than 0.25 inches from the bottom surface.

5. The ink system of claim 1 further comprising a filter module in fluid communication with the pump, wherein the filter module comprises:
- a housing;
- a filter media disposed in the housing;
- a fluid inlet disposed in the housing; and
- a fluid outlet disposed in a bottom portion of the housing, wherein the housing includes a generally conically shaped portion adjacent the fluid outlet.

6. The ink system of claim 1 further comprising a valve controlling the flow of fluid from the ink supply line to a nozzle in the print head, wherein the valve is a media separated valve.

7. A method of operating an ink jet printer comprising:
- providing an ink system comprising:
  - a fluid tank comprising:
    - a generally conically shaped side wall, the side wall sloping inwardly from a top portion to a bottom portion; and
    - a bottom surface disposed adjacent the bottom portion of the side wall; and
  - a first fluid conduit disposed in the fluid tank and comprising an opening adjacent and above the bottom surface of the fluid tank; and
  - a second fluid conduit disposed in the fluid tank and comprising an opening at a location above the opening of the first fluid conduit;
- providing an ink source comprising a volume of ink;
- providing an solvent source comprising a volume of solvent;
- transferring substantially the entire volume of ink to the fluid tank through a supply line; and transferring a portion of the volume of solvent through the ink supply line to flush the supply line;

further comprising performing a mixing process comprising:

conveying the ink composition into the second fluid conduit and out of the first fluid conduit into the fluid tank for a first period of time, wherein the first period of time is at least 30 s; and reversing the flow of the ink composition to convey the ink composition into the first fluid conduit and out of second fluid conduit into the fluid tank for a second period of time, wherein the second period of time is at least 1 min, thereby mixing the ink composition.

8. The method of claim 7 wherein the ink source comprises a volume of pigmented ink in a cartridge.

9. An ink system of an ink jet printer comprising:

a fluid tank comprising:

a generally conically shaped side wall, the side wall sloping inwardly from a top portion to a bottom portion; and a bottom surface disposed adjacent the bottom portion of the side wall;

a first fluid conduit disposed in the fluid tank and comprising an opening adjacent to and above the bottom surface of the fluid tank;

a second fluid conduit disposed in the fluid tank and comprising an opening at a location above the opening of the first fluid conduit;

a pump in fluid communication with the first fluid conduit and the second fluid conduit;

an ink supply line in fluid communication with the pump;

a print head in fluid communication with the ink supply line;

a valve controlling the flow of fluid from the ink supply line to a nozzle in the print head, wherein the valve is a media separated valve;

a return line in fluid communication between the print head and the fluid tank; and a filter module in fluid communication with the pump, wherein the filter module comprises:

a housing;

a filter media disposed in the housing;

a fluid inlet disposed in the housing; and a fluid outlet disposed in a bottom portion of the housing, wherein the housing includes a generally conically shaped portion adjacent the fluid outlet.

10. The ink system of claim 9 further comprising an ink composition comprising a pigment disposed in the fluid tank.

11. The ink system of claim 9 further comprising an ink source in fluid communication with the fluid tank, wherein the ink source comprises a pigmented ink composition provided in a cartridge.

* * * * *